US009889388B2

(12) United States Patent
Liu et al.

(10) Patent No.: US 9,889,388 B2
(45) Date of Patent: Feb. 13, 2018

(54) TOY BUILDING BLOCK ROBOT AND MAIN CONTROL BOX THEREOF

(71) Applicant: UBTECH ROBOTICS CORP., Shenzhen, Guangdong Province (CN)

(72) Inventors: Lefeng Liu, Shenzhen (CN); Yumiao Wu, Shenzhen (CN); Dingkai Xing, Shenzhen (CN)

(73) Assignee: UBTECH ROBOTICS CORP., Shenzhen, Guangdong Province (CN)

( * ) Notice: Subject to any disclaimer, the term of this patent is extended or adjusted under 35 U.S.C. 154(b) by 0 days.

(21) Appl. No.: 15/396,381

(22) Filed: Dec. 30, 2016

(65) Prior Publication Data

US 2017/0274294 A1 Sep. 28, 2017

(30) Foreign Application Priority Data

Mar. 24, 2016 (CN) ..... 2016 1 0171033
Mar. 24, 2016 (CN) ..... 2016 1 0171164
Mar. 24, 2016 (CN) ..... 2016 2 0233044 U
Mar. 24, 2016 (CN) ..... 2016 2 0233862 U

(51) Int. Cl.

| | |
|---|---|
| ***A63H 33/26*** | (2006.01) |
| ***A63H 11/00*** | (2006.01) |
| ***A63H 13/00*** | (2006.01) |
| ***A63H 33/04*** | (2006.01) |
| ***A63H 33/08*** | (2006.01) |

(52) U.S. Cl.

CPC ..... *A63H 33/042* (2013.01); *A63H 11/00* (2013.01); *A63H 13/00* (2013.01); *A63H 33/084* (2013.01); *A63H 33/26* (2013.01)

(58) Field of Classification Search

CPC ..... A63H 11/00; A63H 13/00; A63H 33/042; A63H 33/26

See application file for complete search history.

(56) References Cited

U.S. PATENT DOCUMENTS 4,767,374 A * 8/1988 Yang ..... A63H 3/28 40/457
4,867,726 A * 9/1989 Fujimaki ..... A63H 3/28 446/175
5,211,282 A * 5/1993 Ting ..... A63H 3/28 200/292

(Continued)

*Primary Examiner* — John Ricci
(74) *Attorney, Agent, or Firm* — Cheng-Ju Chiang

(57) ABSTRACT

A toy building block robot and a main control box thereof are disclosed. The main control box comprises a toy building-block robot main control housing, a toy building-block robot main control board, and a battery. The toy building-block robot main control board is installed in the toy building-block robot main control housing. The battery is connected to the toy building-block robot main control board, so as to supply power to the toy building-block robot main control board. A plurality of connection mechanisms are disposed on the toy building-block robot main control housing for engaging the toy building-block robot main control housing with other components of the toy building block robot. In the present disclosure, whether the assembly of the components in the main control box, or the engagement between the main control box and other components of the toy building block robot, can both be realized through a connection mechanism.

17 Claims, 17 Drawing Sheets

(56) References Cited

U.S. PATENT DOCUMENTS

| | | | | | |
|---|---|---|---|---|---|
| 5,742,486 | A * | 4/1998 | Yangkuai | A63H 33/042 | 361/807 |
| 6,071,169 | A * | 6/2000 | Cook | A63H 3/001 | 446/295 |
| 7,825,346 | B2 * | 11/2010 | Chu | H03K 17/9645 | 200/511 |
| 8,713,846 | B1 * | 5/2014 | Thrash | A01M 31/06 | 43/2 |
| 2012/0122059 | A1 * | 5/2012 | Schweikardt | A63H 33/04 | 434/118 |

* cited by examiner

TOY BUILDING BLOCK ROBOT AND MAIN CONTROL BOX THEREOF

CROSS REFERENCE TO RELATED APPLICATIONS

This application claims priority to Chinese Patent Application Nos. 201610171164.X, 201610171033.1, 201620233044.3, and 201620233862.3, all filed on Mar. 24, 2016, which are hereby incorporated by reference herein as if set forth in their entirety.

TECHNICAL FIELD

The present disclosure generally relates to toy building block robots, and more particular relates to a toy building block robot and a main control box for the toy building block robot.

BACKGROUND

A toy building block robot generally comprises a main control box, servos, building blocks, and decoration components. After connecting the main control box and the servos through the building blocks, the decoration components are used to decorate the appearance of the toy building block robot, thereby providing the robots of various appearances. Wherein the main control box and the servos are the core components to implement the movement of the robot. The main control box controls the servos to operate, while the main control box is equivalent to the brain of the toy building block robot.

However, whether when assembling the components of the main control box itself, or when assembling the main control box with the servos, the building blocks, or the decoration components, screws or other similar components are often used to secure or engage different components, which increases the complexity of the assembly process. Due to the inconvenience in practice, the users' experience is not good, and the user's imagination to assemble various models is limited.

SUMMARY

Embodiments of the present disclosure provide a toy building block robot and main control box, which simplifies the assembly process of the toy building block robot.

One embodiment of the present disclosure is: providing a main control box for a toy building-block robot, comprising a toy building-block robot main control housing, a toy building-block robot main control board, and a battery. The toy building-block robot main control board is installed in the toy building-block robot main control housing, the battery is connected to the toy building-block robot main control board to supply power to the toy building-block robot main control board; a plurality of connection mechanisms are disposed on the toy building-block robot main control housing for engaging the toy building-block robot main control housing with other components of the toy building block robot.

Another embodiment of the present disclosure is: providing a toy building block robot comprising a main control box. The main control box comprising a toy building-block robot main control housing, a toy building-block robot main control board, and a battery, wherein the toy building-block robot main control board is installed in the toy building-block robot main control housing, the battery is connected to the toy building-block robot main control board to supply power to the toy building-block robot main control board; a plurality of connection mechanisms are disposed on the toy building-block robot main control housing for engaging the toy building-block robot main control housing with other components of the toy building block robot.

Advantages of the present disclosure may follow. In comparison with the current implementations, since connection mechanisms are disposed on the toy building-block robot main control housing, which are used to engage the toy building-block robot main control housing with other components of the toy building block robot, whether the assembly of the components in the main control box, or the engagement between the main control box and other components of the toy building block robot, can both be realized through a connection mechanism. Hence, the assembly process of the toy building block robot is simplified since particular assembly tools are no more needed. Consequently, users' experience would be better, and users' imaginations could be brought into full play so as to assemble various toy building block robot models.

DETAILED DESCRIPTION

For a thorough understanding of the present disclosure, numerous specific details are set forth in the following description for purposes of illustration but not of limitation, such as particularities of system structures, ports, techniques, et cetera. However, it should be appreciated by those of skill in the art that, in absence of these specific details, the present disclosure may also be carried out through other implementations. In other instances, a detailed description of well-known devices, circuits, and methods is omitted, so as to avoid unnecessary details from hindering the description of the disclosure.

The following embodiments describe toy building block robots and main control boxes for a toy building block robot according to the disclosure.

Figure 1:
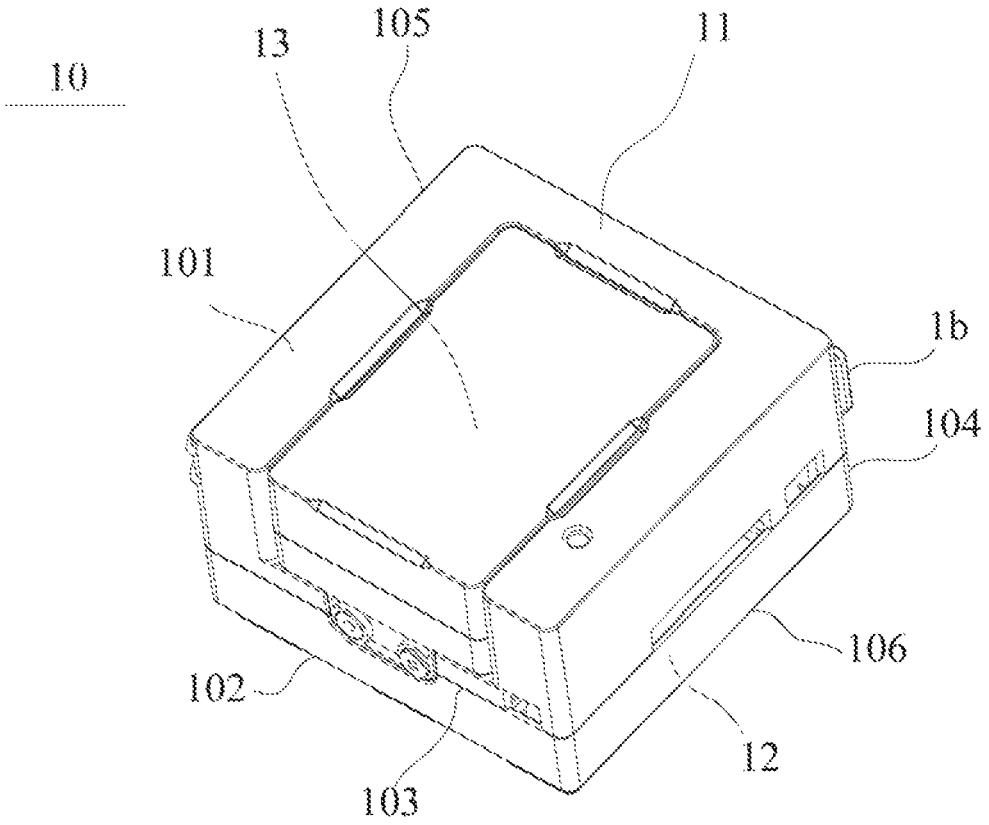
FIG. 1 is a three dimensional schematic diagram of a front-right-top view of a main control box of an embodiment according to the disclosure.
Figure 2:
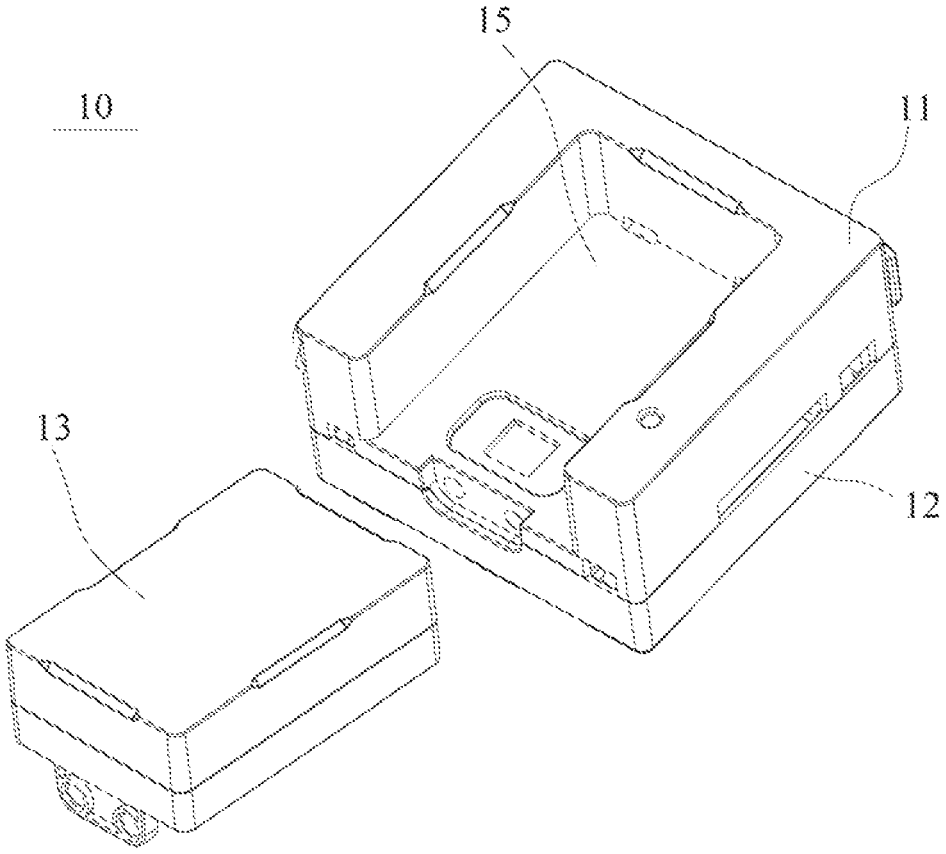
FIG. 2 is a schematic diagram of a decomposition of the main control box shown in FIG. 1.

As shown in FIG. 1 and FIG. 2, a toy building block robot of an embodiment of the present disclosure comprises a main control box 10. The main control box 10 comprises a toy building-block robot main control housing, a toy building-block robot main control board 15, and a battery 13. The toy building-block robot main control board 15 is installed in the toy building-block robot main control housing. The battery 13 is connected to the toy building-block robot main control board 15, so as to supply power to the toy building-block robot main control board 15. A plurality of connection mechanisms are disposed on the toy building-block robot main control housing, which are used to engage the toy building-block robot main control housing with other components of the toy building block robot.

Particularly, the toy building-block robot main control housing comprises a bottom housing 12 and a top housing 11. An accommodation space is formed between the bottom housing 12 and the top housing 11, wherein the toy building-block robot main control board 15 is installed within the accommodation space.

For the convenience to describe the aspects of the toy building-block robot main control housing, six faces on the toy building-block robot main control housing are respectively defined as a top face 101, a bottom face 102, a front face 103, a back face 104, a left face 105, and a right face 106.

Figure 3:
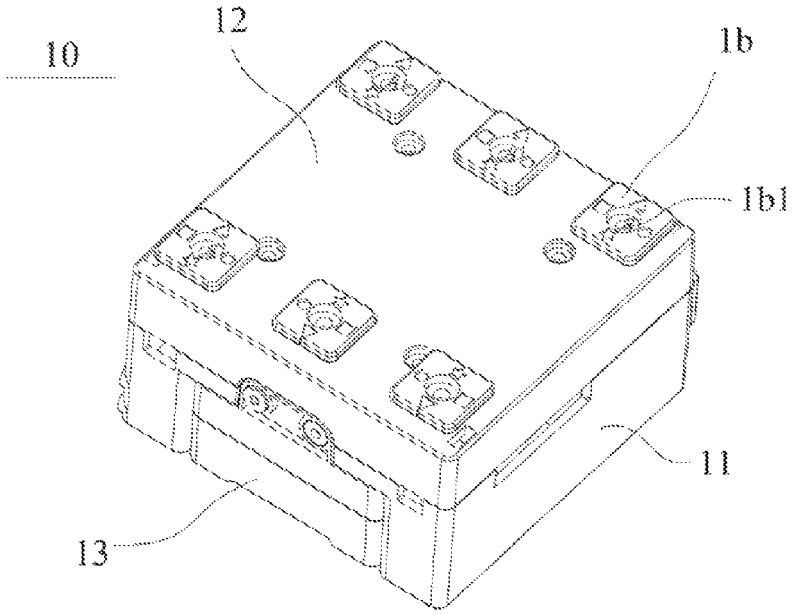
FIG. 3 is a three dimensional schematic diagram of a front-bottom view of the main control box shown in FIG. 1.
Figure 4:
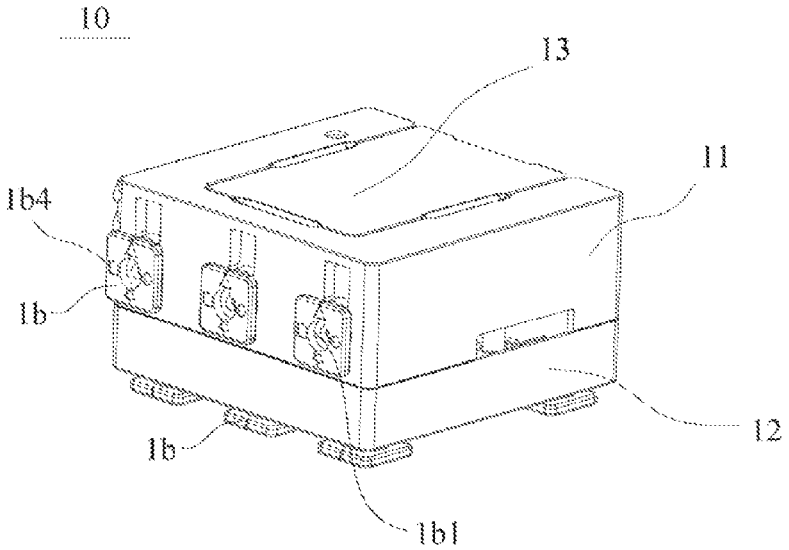
FIG. 4 is a three dimensional schematic diagram of a back-top view of the main control box shown in FIG. 1.

As shown in FIG. 3 and FIG. 4, the connection mechanisms of this embodiment comprise a plurality of connecting portions. The connecting portions are disposed on an outer surface of the toy building-block robot main control housing, particularly, the bottom face 102 and the back face 104 of the toy building-block robot main control housing, wherein 6 of the connecting portions are disposed on the bottom face 102, 3 of the connecting portions are disposed on the back face 104.

It can be understood that, in other embodiments, the location and the amount of the connecting portions on the main control box 10 can be changed in accordance with actual demands. The connecting portions are configured to engage into a butting slot of other components of the toy building block robot, for example, a building block, a servo, or a decoration component of the toy building block robot, thereby realizing the connection between the main control box 10 as well as the building block, the servo, the decoration component, etc.

Figure 5:
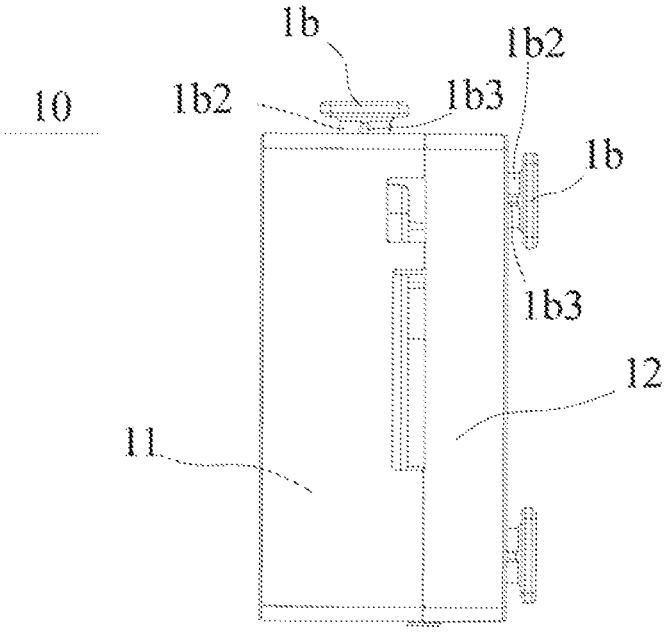
FIG. 5 is a schematic diagram of a side view of the main control box shown in FIG. 1.
Figure 6:
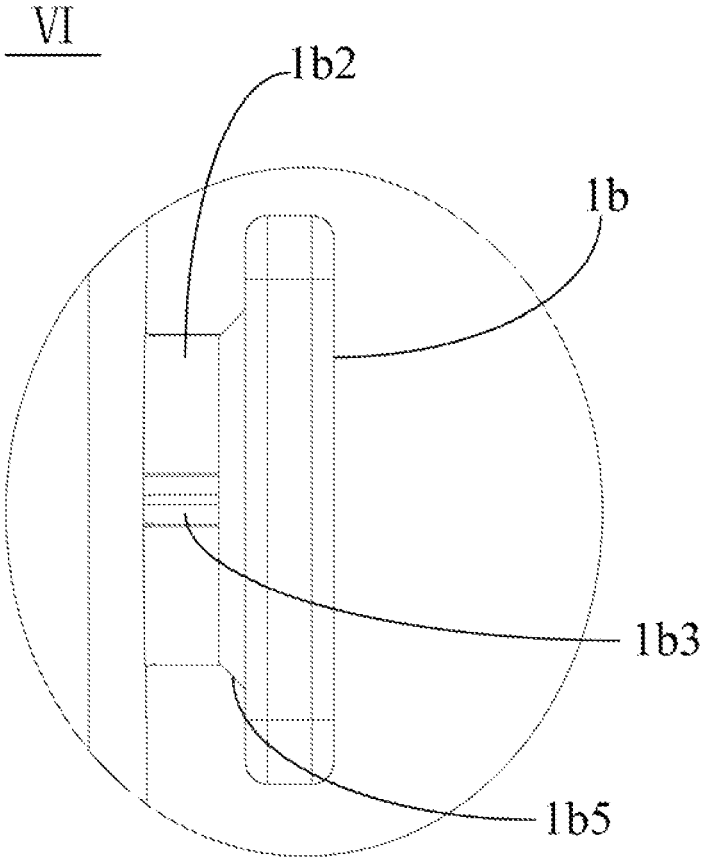
FIG. 6 is an enlarged drawing of a VI region shown in FIG. 5.

As shown in FIG. 5 and FIG. 6, the connecting portion comprises a connection pillar 1*b*2 and a connection plate 1*b*. In this embodiment, the connection pillar 1*b*2 and the connection plate 1*b* are integratedly molded. Each of the connection plate 1*b* is installed on the outer surface of the toy building-block robot main control housing through the connection pillar 1*b*2.

Particularly, there are various methods to fix the connecting portion on the toy building-block robot main control housing. A screw hole 1*b*1 is formed in the connection plate 1*b* and the connection pillar 1*b*2, such that a screw could pass through the screw hole 1*b*1 to fix the connecting portion on the outer surface of the toy building-block robot main control housing. In other embodiments, the connecting portion and the toy building-block robot main control housing could be integratedly molded, or the connecting portion could be fixed on the toy building-block robot main control housing through adherence.

The shape of the connection plate 1*b* could be various. In this embodiment, a square-shaped design is adopted. In comparison with a round shape, a square shape facilitates differentiating different aspects of the connection plate 1*b*. In comparison with a rectangular shape or other shapes, since the sides of a square have a same length, the connection plate 1*b* has a same structure in four aspects, and is convenient in connecting with other components of the toy building block robot.

A top face of the connection plate 1*b* has direction symbols 1*b*4 disposed thereon. In the assembly process using the connecting portions, if need to assemble in accordance with a particular aspect, the direction symbols 1*b*4 could be used to determine the corresponding aspect. For instance, symbols Δ, □, ☆, and ○ can be disposed on the connection plate 1*b*, so as to respectively represented four aspects of the connection plate 1*b*. In addition, other symbols, graphs, or characters could be adopted to represent the aspects of the connection plate 11. For instance, the characters E, W, N, and S are used to represent four aspects of the connection plate 1*b*.

The connection pillar 1*b*2 has at least one set of limit grooves 1*b*3 which is disposed opposite to each other. The limit grooves 1*b*3 are used to match limit protrudes on a butting slot of other components of the toy building block robot, thereby limiting the connecting portion within the butting slot. In this embodiment, four limit grooves 1*b*3 are uniformly distributed on the connection pillar 1*b*2. Each of the limit grooves 1*b*3 is disposed in alignment with the center of each side of the square connection plate 1*b*, and two opposite limit grooves 40 are disposed on a same diameter of the cylindrical connection pillar 1*b*2.

A chamfer 1*b*5 is disposed on a junction between the connection pillar 1*b*2 and the connection plate 1*b*. The chamfer 1*b*5 matches a chamfer on the butting slot of other components of the toy building block robot, which facilitates the connection between the connecting portion and other components.

Wherein, since the servo has been disclosed in the prior patent application of the applicant, the details are not recited herein. The decoration components are used to decorate the toy building block robot, thereby providing a particular appearance style to the toy building block robot. Since both the decoration components known by the technicians of this technical field and the decoration components designed according to actual demands could be adopted, the details are not recited herein.

The building blocks have various structures which being described as follows.

Figure 7:
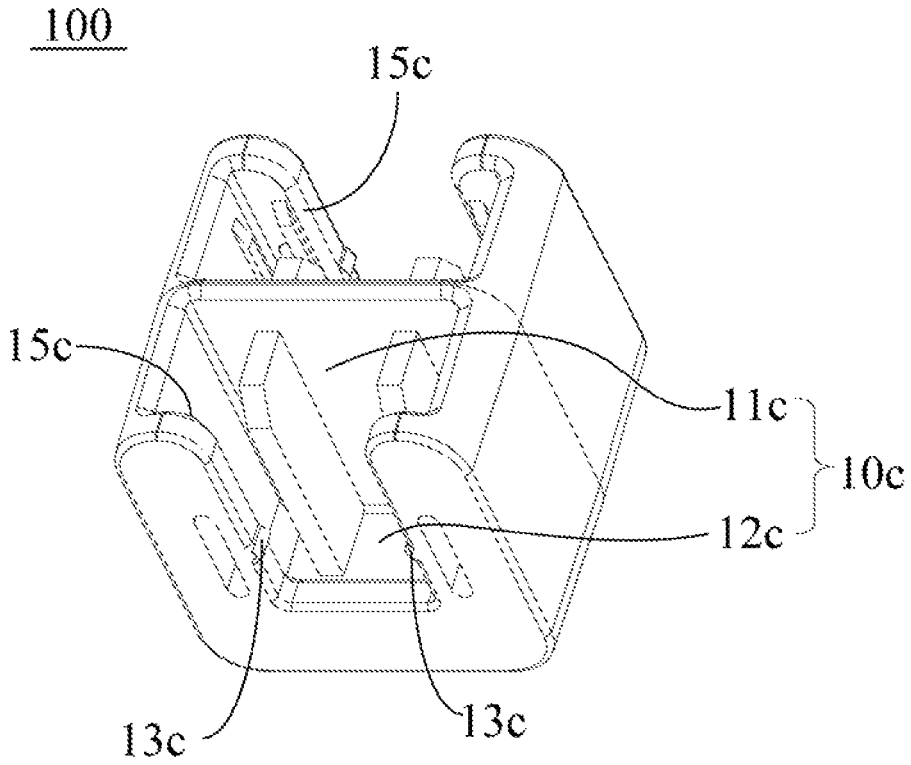
FIG. 7 to FIG. 13 are isometric views of various building blocks of embodiments according to the disclosure.

As shown in FIG. 7, the building block 100 comprises two butting slots 10*c*. The butting slot 10*c* comprises a plate slot 11*c* for accommodating the connection plate 1*b* and a pillar slot 12*c* for accommodating the connection pillar 1*b*2.

Wherein, two sides of the pillar slot 12*c* have the limit protrudes 13*c*, and the building block 100 could be engaged with other components (e.g., the main control box 10, another building block 100, the servo, or the decoration component) with the connection plate 1*b*. For instance, when the connection plate 1*b* of the connecting portion of the main control box 10 is inserted into the plate slot 11*c*, the connection pillar 1*b*2 is simultaneously inserted into the pillar slot 12*c*, and the limit protrudes 13*c* on the pillar slot 12*c* are inserted into the limit grooves 1*b*3 on the connection pillar 1*b*2, the connecting portion is therefore limited within the butting slot 10*c*. An inner side of the pillar slot 12*c* has a chamfer 15*c* which matches the chamfer 1*b*5 on the connection pillar 1*b*2.

Figure 8:
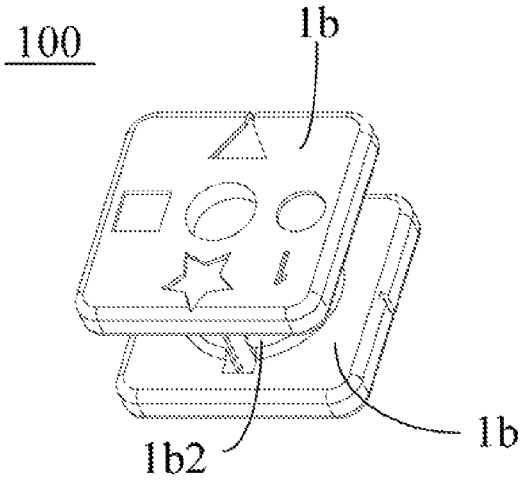

As shown in FIG. 8, the building block 100 comprises a connection pillar 1*b*2 and connection plates 1*b* disposed on two ends of the connection pillar 1*b*2. The connection plates 1*b* could be inserted into the plate slot 11*c* of the building block 100 as shown in FIG. 7, FIG. 9, FIG. 10, FIG. 11, FIG. 12, and FIG. 13.

Figure 9:
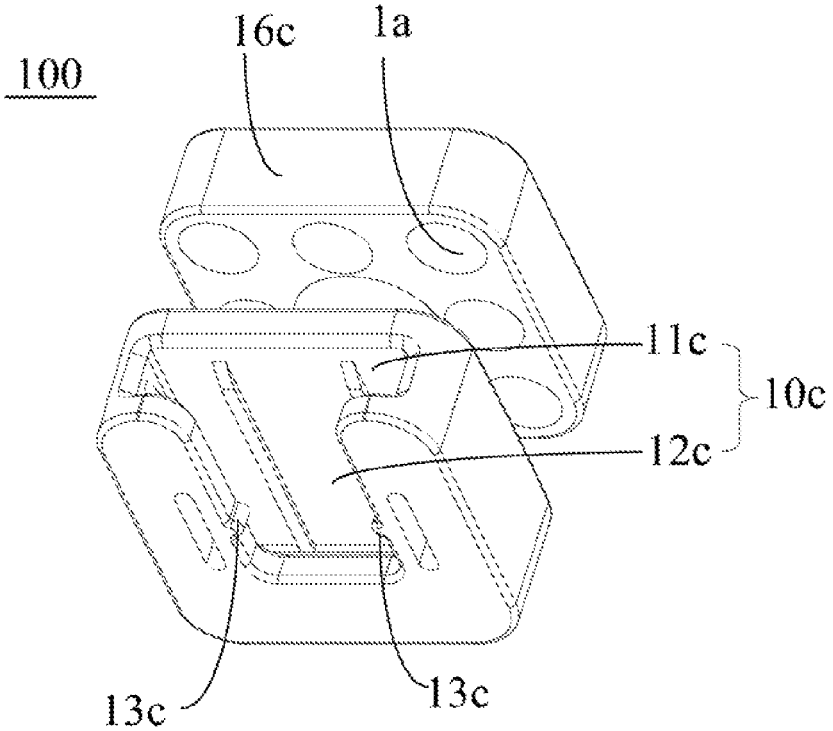

As shown in FIG. 9, the building block 100 comprises a butting slot 10*c* and a block connecting portion 16*c*. The block connecting portion 16*c* has connection pin holes 1*a*, which is used to engage the building block 100 with other components (e.g., the servo, the main control box 10, another building block 100, or the decoration component) with the connection pin holes 1*a* through a bearing pin. The butting slot 10*c* shown in FIG. 9 has a same structure with the above-mentioned butting slot 10*c*, which could be engaged with the main control box 10 or other components with the connection plates 1*b*, and could match the limit grooves 1*b*3 on the connection pillar 1*b*2 with the limit protrudes 13*c* on the pillar slot 12*c*, thereby limiting the connecting portion within the butting slot 10*c*.

Figure 10:
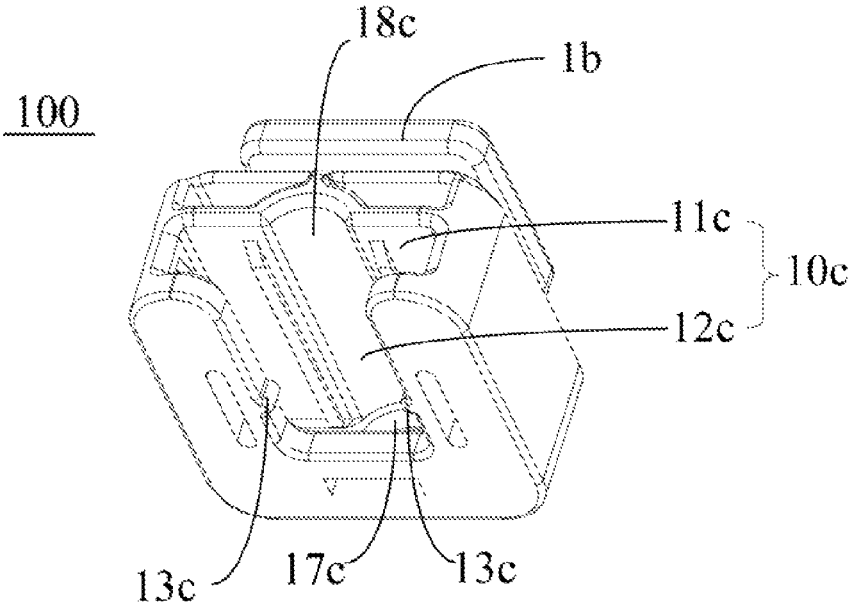

As shown in FIG. 10, the building block 100 comprises a connection plate 1*b* and a butting slot 10*c* which are disposed opposite to each other. The butting slot 10*c* comprises a plate slot 11*c* for accommodating the connection plate 1*b* and a pillar slot 12*c* for accommodating the connection pillar 1*b*2. Wherein, two sides of the pillar slot 12*c* have limit protrudes 13*c*, the bottom of the butting slot 10*c* has a connecting hole 17*c*, and a side wall of the butting slot 10*c* has a hollow area 18*c* corresponding to the connecting hole 17*c*. The building block 100 could be connected with other components with a connecting hole by inserting a bearing pin into the connecting hole 17*c* on the building block 100 and the connecting hole on other components, while the hollow area 18*c* accommodates the bearing pin. The butting slot 10*c* could be engaged with other components with the connection plate 1*b*, and could match the limit grooves 1*b*3 on the connection pillar 1*b*2 with the limit protrudes 13*c* on the pillar slot 12*c*. The connection plate 1*b* of the building block 100 could be engaged into the butting slot 10*c* of other components.

Figure 11:
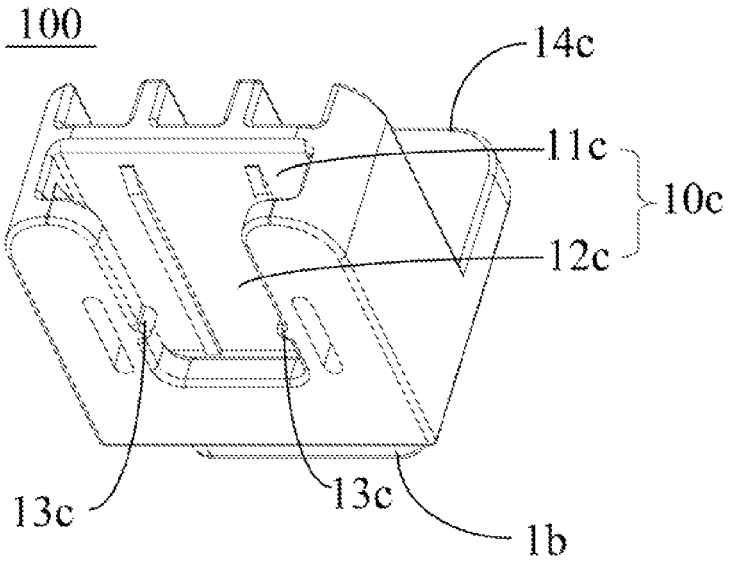

The building block 100 could have a structure as shown in FIG. 11, that is, the building block 100 comprises a connection plate 1*b*, a butting slot 10*c*, and a body 14*c*. The connection plate 1*b* and the butting slot 10*c* are respectively on different sides of the body 14*c*, while the connection plate 1*b* and the butting slot 10*c* are perpendicular to each other. The butting slot 10*c* comprises the plate slot 11*c* for accommodating the connection plate 1*b* and a pillar slot 12*c* for accommodating the connection pillar 1*b*2, wherein two sides of the pillar slot 12*c* have the limit protrudes 13*c*. The butting slot 10*c* could be engaged with other components with the connection plate 1*b*, and could match the limit grooves 1*b*3 on the connection pillar 1*b*2 with the limit protrudes 13*c* on the pillar slot 12*c*. The connection plate 1*b* could be engaged with other components with the butting slot 10*c*.

Figure 12:
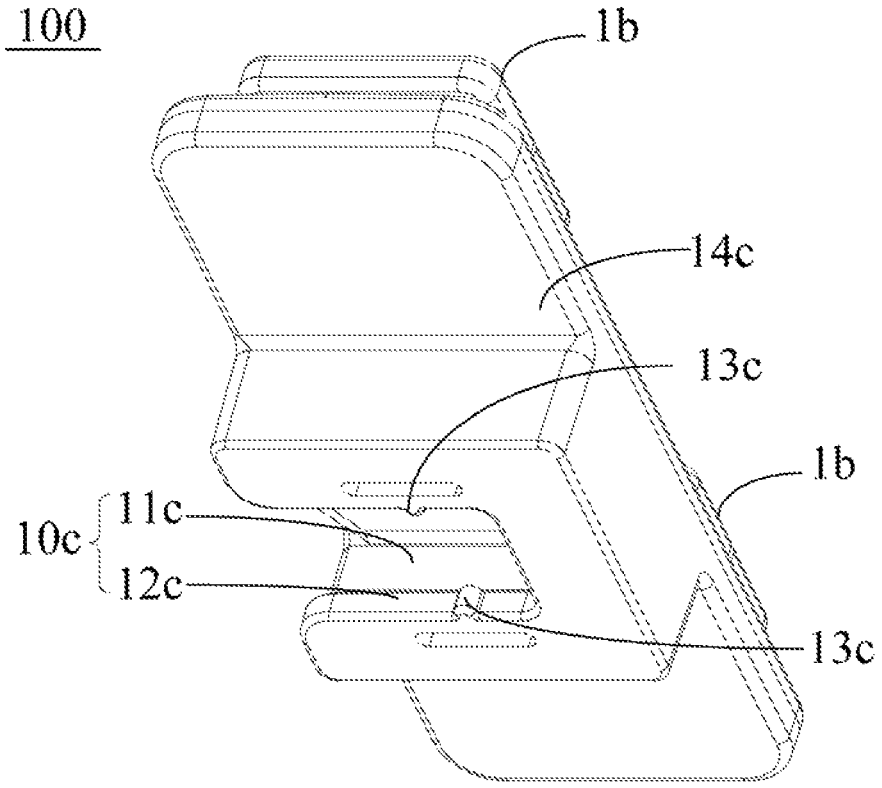

As shown in FIG. 12, the building block 100 comprises a butting slot 10*c*, two connection plates 1*b*, and a body 14*c*. Wherein, the two connection plates 1*b* and the butting slot 10*c* are respectively disposed on different sides of the body 14, the two connection plates 1*b* are respectively disposed on two ends of the body 14*c*, and the butting slot 10*c* is disposed on the center of the body 14*c*. The connection plate 1*b* could be engaged with other components with the butting slot 10*c*. The butting slot 10*c* comprises a plate slot 11*c* for accommodating the connection plate 1*b* and a pillar slot 12*c* for accommodating the connection pillar 1*b*2. Wherein, two sides of the pillar slot 12*c* have limit protrudes 13*c*. The butting slot 10*c* could be engaged with other components with the connection plate 1*b*, and could match the limit grooves 1*b*3 on the connection pillar 1*b*2 with the limit protrudes 13*c* on the pillar slot 12*c*. The connection plate 1*b* could be engaged with other components with the butting slot 10*c*.

Figure 13:
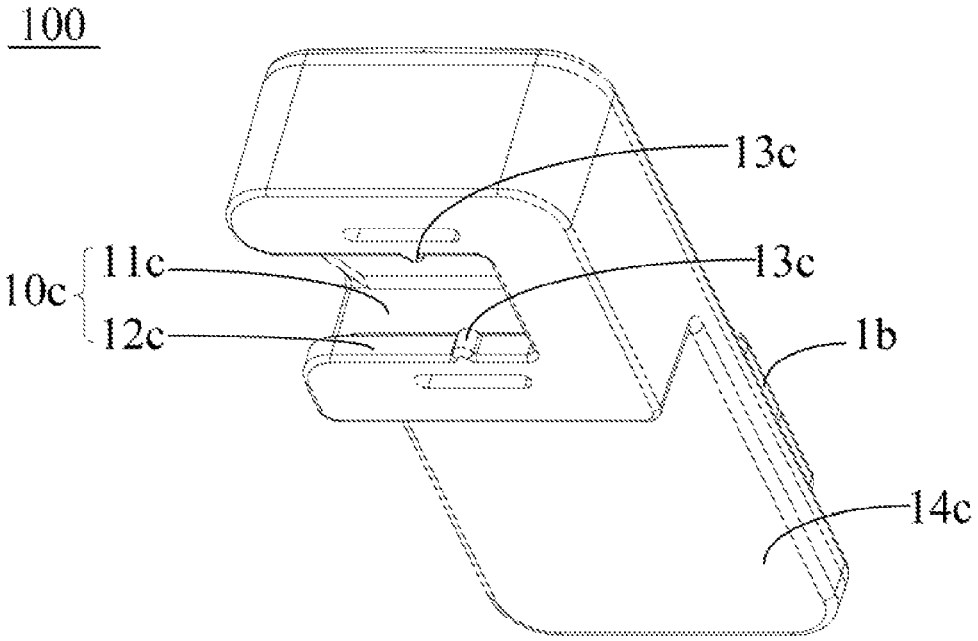
Figure 14:
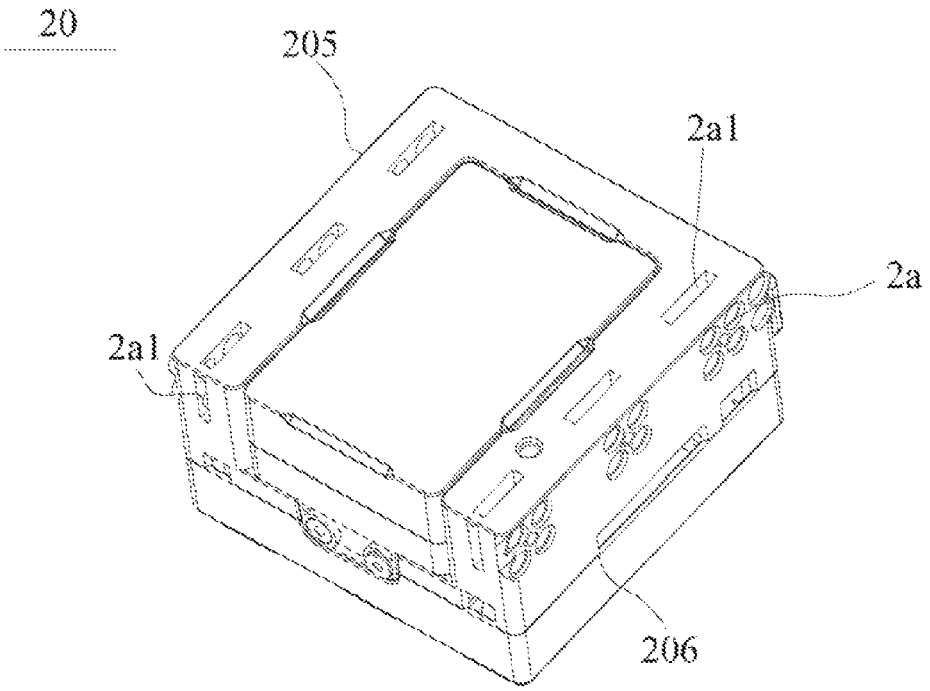
FIG. 14 is a three dimensional schematic diagram of a front-right-top view of a main control box of another embodiment according to the disclosure.
Figure 15:
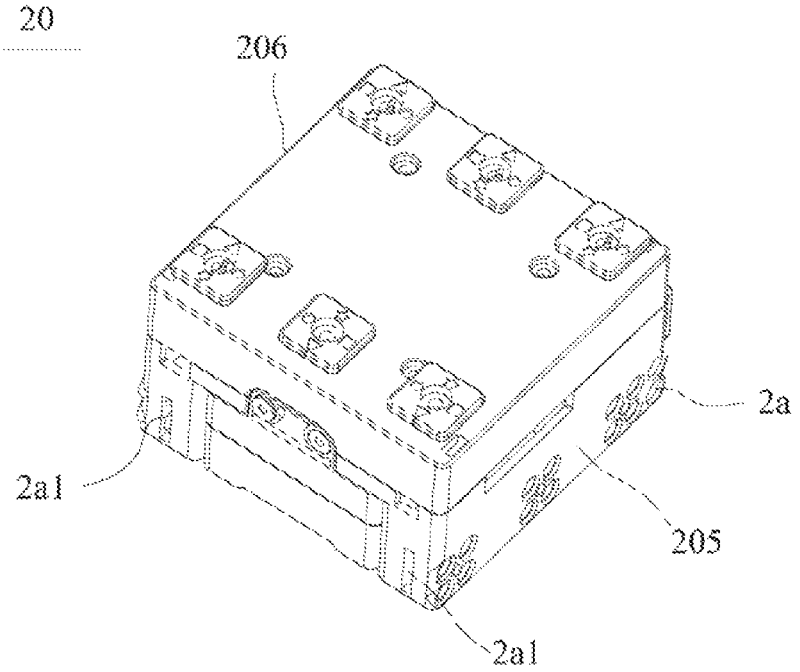
FIG. 15 is a three dimensional schematic diagram of a front-bottom view of the main control box shown in FIG. 14.
Figure 16:
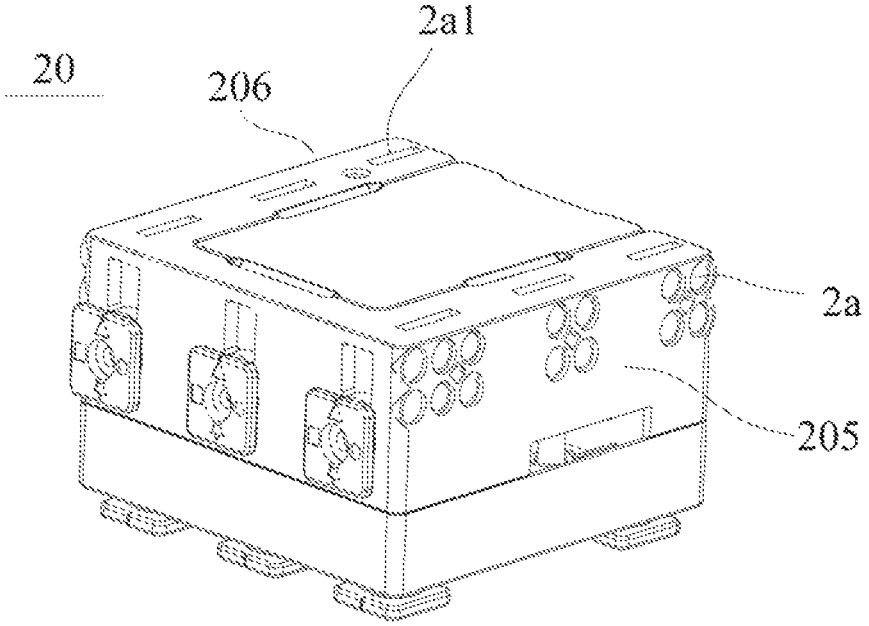
FIG. 16 is a three dimensional schematic diagram of a back-top view of the main control box shown in FIG. 14.
Figure 17:
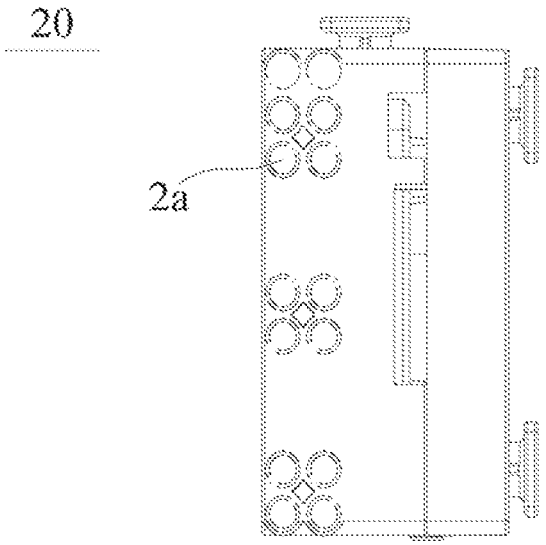
FIG. 17 is a schematic diagram of a side view of the main control box shown in FIG. 14.

As shown in FIG. 13, the building block 100 comprises a butting slot 10*c*, a connection plate 1*b*, and a body 14*c*. Wherein, the connection plate 1*b* and the butting slot 10*c* are respectively disposed on two sides of the body 14, and respectively located at two ends of the body 14*c*. The connection plate 1*b* could be engaged with other components with the butting slot 10*c*. The butting slot 10*c* comprises a plate slot 11*c* for accommodating the connection plate 1*b* and a pillar slot 12*c* for accommodating the connection pillar 1*b*2. Wherein, two sides of the pillar slot 12*c* has limit protrudes 13*c*. The butting slot 10*c* could be engaged with other components with the connection plate 1*b*, and could match the limit grooves 1*b*3 on the connection pillar 1*b*2 with the limit protrudes 13*c* on the pillar slot 12*c*. The connection plate 1*b* could be engaged with other components with the butting slot 10*c*.

In the toy building block robot and the main control box 10 thereof of this embodiment, a plurality of connection mechanisms comprising the connection pillar 1*b*2 and the connection plate 1*b* are disposed on the main control box 10. As a result, the connection plate 1*b* and the connection pillar 1*b*2 could be engaged into the butting slot 10*c* on the servo, the building block 100, or the decoration component. Hence, the assembly process of the toy building block robot is simplified since particular assembly tools are no more needed. Consequently, users' experience would be better, and users' imaginations could be brought into full play so as to assemble various toy building block robot models. Simultaneously, the limit grooves 1*b*3 and the limit protrudes 13*c* which respectively disposed on the connection pillar 1*b*2 and the butting slot 10*c* matches with each other, so as to realize a tight match between the main control box 10 and other components of the toy building block robot, thereby guaranteeing the tightness of the connection between the main control box 10 and other components of the toy building block robot and preventing the failure of the connection in the process of assembling the toy building block robot.

Referring to FIG. 14 to FIG. 17, a toy building block robot of another embodiment of the present disclosure comprises a main control box 20. The connection mechanism of the main control box 20 further comprises a plurality of connection pin holes 2*a* disposed on the toy building-block robot main control housing, which are used to engage the main control box 20 with other components of the toy building block robot through a bearing pin. The other components comprise a servo, building blocks, decoration components, etc. If only the servo, the building block, or the decoration component also has the connection pin holes 2*a*, it can be installed on the main control box 20 through a bearing pin.

Figure 18:
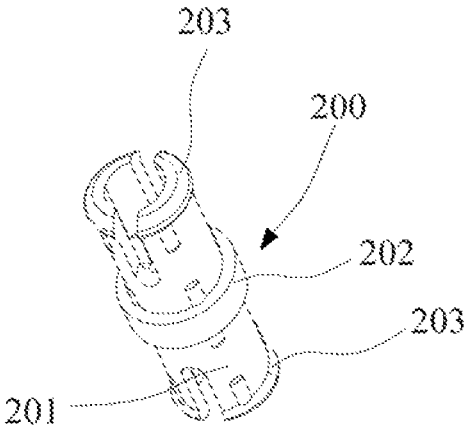
FIG. 18 is an isometric view of a bearing pin of an embodiment according to the disclosure.

Particularly, as shown in FIG. 18, the bearing pin 200 comprises a cylindrical pin body 201 and two inverse buckle protrude portions 203 disposed on two ends of the cylindrical pin body 201 respectively, while a limit stage 202 is disposed on the middle of the cylindrical pin body 201. The bearing pin 200 is limited by the above-mentioned inverse buckle protrude portion 203 and the limit stage 202 while installed in the above-mentioned connection pin hole 2*a*. The limit stage 202 divides the cylindrical pin body 201 into an upper portion and a lower portion. When installing the building block 100 shown in FIG. 9 on the main control box 10, two portions of the cylindrical pin body 201 on two ends of the limit stage 202 are respectively inserted into the connection pin hole 2*a* on the main control box 20 and the connection pin hole 1*a* on the building block 100, thereby realizing installing the building block 100 shown in FIG. 9 on the main control box 20.

Gap slots 2*a*1 are disposed adjacent to the connection pin holes 2*a*. As a result, when the bearing pin 200 is inserted into the connection pin holes 2*a*, the inverse buckle protrude portion 203 on the bearing pin 200 could be engaged into the gap slots 2*a*1, thereby realizing engaging the bearing pin 200 within the connection pin holes 2*a*.

In this embodiment, a plurality of the connection pin holes 2*a* are respectively disposed on the left face 205 and the right face 206 of the toy building-block robot main control housing of the main control box 20. Wherein, both of the left face 205 and the right face 206 have 14 connection pin holes 2*a* disposed thereon.

It can be understood that, in other embodiments, the amount and the location of the connection pin holes 2*a* could be changed in accordance with actual demands.

In addition to connect with other components of the toy building block robot through the connecting portion, the main control box 20 of this embodiment could connect with other components (e.g., the servo, the building block 100, or the decoration component) through assembling the bearing pin 200 into the connection pin hole 1*a* and the connection pin hole 2*a*. Hence, the assembly/disassembly process of the toy building block robot is simplified since particular assembly tools are no more needed. Consequently, users' experience would be better, and users' imaginations could be brought into full play so as to assemble various toy building block robot models.

Figure 19:
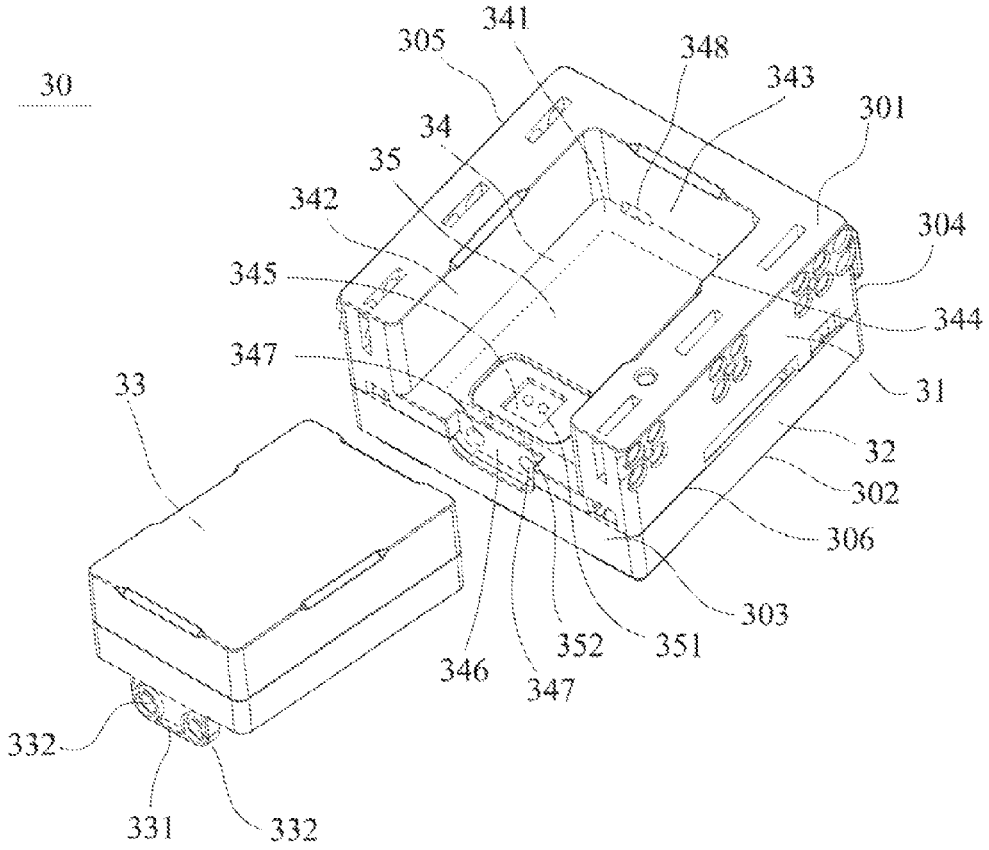
FIG. 19 is a schematic diagram of a decomposition of a main control box of still another embodiment according to the disclosure.

Referring to FIG. 19, the toy building block robot of still another embodiment of the present disclosure comprises a main control box 30. Particularly, the connection mechanism of the main control box 30 further comprises a slot 34 disposed on an outer surface of the toy building-block robot main control housing. The slot 34 is used to engage with the battery 33, wherein the location of the slot 34 on the main control box 30 could be designed corresponding to the structure of the toy building-block robot main control housing, and the details are not recited herein.

In order to facilitate the technicians of this technical field to comprehend the aspects described in this embodiment, a face of the toy building-block robot main control housing where an opening of the slot 34 locates is defined as a front face 303 of the toy building-block robot main control housing, and another face of the toy building-block robot main control housing which opposite to the front face 303 is defined as a back face 304. Both flanks of the slot 34 are defined as a left face 305 and a right face 306. Since the slot 34 is disposed on a top housing 31 of the toy building-block robot main control housing, the battery 33 is disposed on a top face 301 of the main control box 30, wherein the top face 301 is opposite to a bottom face 302 of the main control box 30 (the battery 33 could also be disposed on a bottom housing 32 of the toy building-block robot main control housing). The slot 34 is a truck-type concave slot which has a front opening formed on the front face 303. The slot 34 is confined by a bottom side 341, a left side 342, a back side 343, and a right side 344.

The slot 34 is designed to have a truck-type concave shape. The truck-type concave shape means the shape of the slot 34 like a truck, and the left side 342, the back side 343, and the right side 344 in the peripheral of the slot 34 jointly form a concave, hence the truck-type concave shape is used to portray the slot 34.

The toy building-block robot main control board 35 of the main control box 30 has power terminals 351 disposed thereon. The power terminals 351 on the toy building-block robot main control board 35 exposes within the slot 34. Since various techniques known by the technicians of this technical field could be adopted to implement the toy building-block robot main control board 35, the details are not recited herein.

Wherein, a power hole 345 is disposed on the bottom side 341 of the slot 34, and the power terminals 351 on the toy building-block robot main control board 35 locates within the power hole 345. In this embodiment, the power hole 345 locates at a front end of the slot 34. In other embodiments, the power hole 345 could be disposed on any other positions of the bottom side 341. Furthermore, the power hole 345 could also be disposed on the left side 342, the right side 344, or the back side 343.

Figure 20:
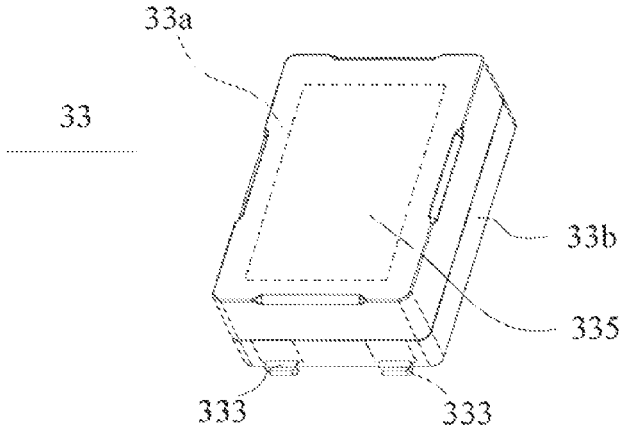
FIG. 20 is a schematic diagram of an angle of a battery shown in FIG. 19.
Figure 21:
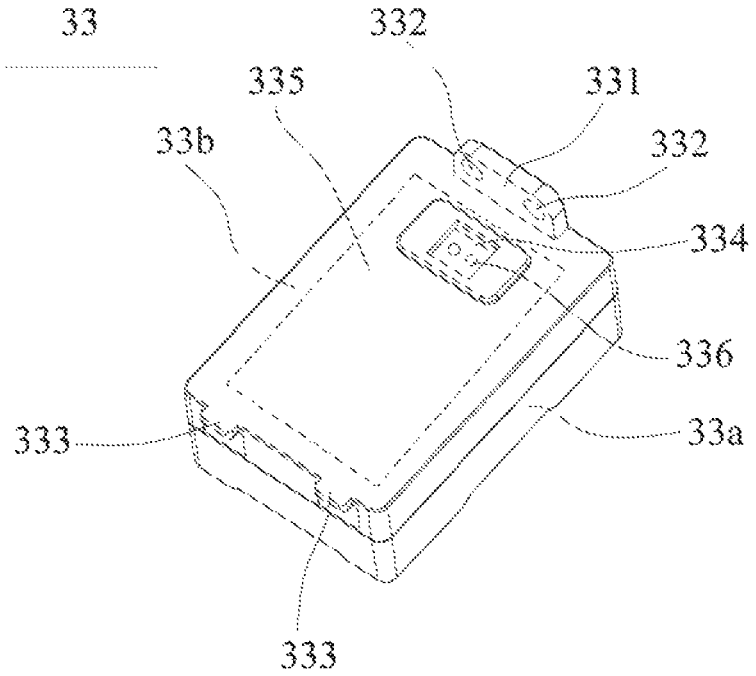
FIG. 21 is a schematic diagram of another angle of a battery shown in FIG. 19.

Referring to FIG. 20 and FIG. 21, the battery 33 comprises a battery case and an electric core 335 in the battery case. The battery case of the battery 33 comprises an upper case 33*a* and a lower case 33*b*. The electric core 335 has positive and negative electrodes 336. Since various secondary batteries known by the technicians of this technical field, for example, lithium battery, could be adopted to implement the electric core 335, the details are not recited herein.

An electrode hole 334 corresponding to the power hole 345 is formed on a side of the battery case which matches the bottom side 341 of the slot 34. The electrodes 336 of the electric core 335 locate within the electrode hole 334. It can be understood that if the power hole 345 is disposed on the left side 342, the right side 344, or the back side 343 on the slot 34, the location of the electrode hole 334 on the battery 33 has to be correspondingly adjusted, such that the power hole 345 and the electrode hole 334 could correspond to each other. The electrodes 336 on the battery 33 is electrically connected to the power terminals 351 of the toy building-block robot main control board 35, thereby providing power to the toy building-block robot main control board 35.

Wherein, the connection mechanism of this embodiment further comprises one or more engagement holes 348 disposed in the slot 34. One or more protrudes 333 are disposed on the battery 33. The protrudes 333 are connected with the engagement holes 348 through engaging. As a result, the limiting and the fixing of the battery 33 can be achieved through the engagement hole 348 and the protrude 333, such that the engaging of the battery 33 can be realized when the battery 33 is installed in the slot 34.

Simultaneously, a step portion 346 is disposed on the front opening of the truck-type concave slot 34. A protrude portion 331 is disposed on the battery 33. The protrude portion 331 is assembled within the step portion 346. Particularly, the protrude portion 331 is disposed on a lower surface of the lower case 33*b* of the battery 33, and as shown in the figure, the above-mentioned electrode hole 334 of this embodiment is also disposed on the lower surface.

The connection mechanism of this embodiment further comprises at least one connecting recess 347 disposed on the step portion 346, and at least one connecting hole 332 is correspondingly disposed on the protrude portion 331. The battery 33 is fixed within the slot 34 through assembling an assembly part in the connecting recess 347 and the connecting holes 332. The assembly part could be a bearing pin, a spline, etc. Through the cooperation of the assembly part, the connecting hole 332, and the connecting recess 347, the protrude portion 331 could be effectively fixed within the step portion 346, thereby implementing fixing the battery 33 within the slot 34. The amount of the connecting hole 332 corresponds to the amount of the connecting recess 347, wherein the amount could be multiple. In this embodiment, there are two connecting holes 332 and two connecting recesses 347.

Generally, the toy building-block robot main control board 35 has various indicator lights 352 which are used to indicate the electricity quantity, the on/off status of main control box 30, etc. In this embodiment, as an improvement, the assembly part is a bearing pin formed by transparent material. The indicator lights 352 are disposed on the toy building-block robot main control board 35. The light of the indicator lights 352 are capable of passing through the bearing pin formed by the transparent material. As a result, the fixing and the light conduction can be simultaneously achieved through the bearing pin formed by the transparent material.

The battery 33 in the main control box 30 of this embodiment is installed in the slot 34 of the main control box 30 through cartridge method, and is connected to the toy building-block robot main control housing through engaging. As a result, the installation, the maintenance, and the change of the battery 33 are simplified.

It can be understood that, in other embodiments, the connection mechanism on the main control box could comprises one or more types of components, that is, the connecting portion, the connection pin hole, and the slot of the above-mentioned embodiments.

The main control box 30 further has various input/output ports disposed thereon. The input/output ports could be used to realize the connection with the servo or an external device, or realize the burning of programs.

However, when assembling the main control box 30, the servo, the building blocks, and the decoration components into a toy building block robot of various models, the peripheral of the main control box 30 often installed with the servo, the building blocks, or the decoration components. Consequently, the power switch is often hided, which causes the difficulties in finding and operating the power switch.

Figure 22:
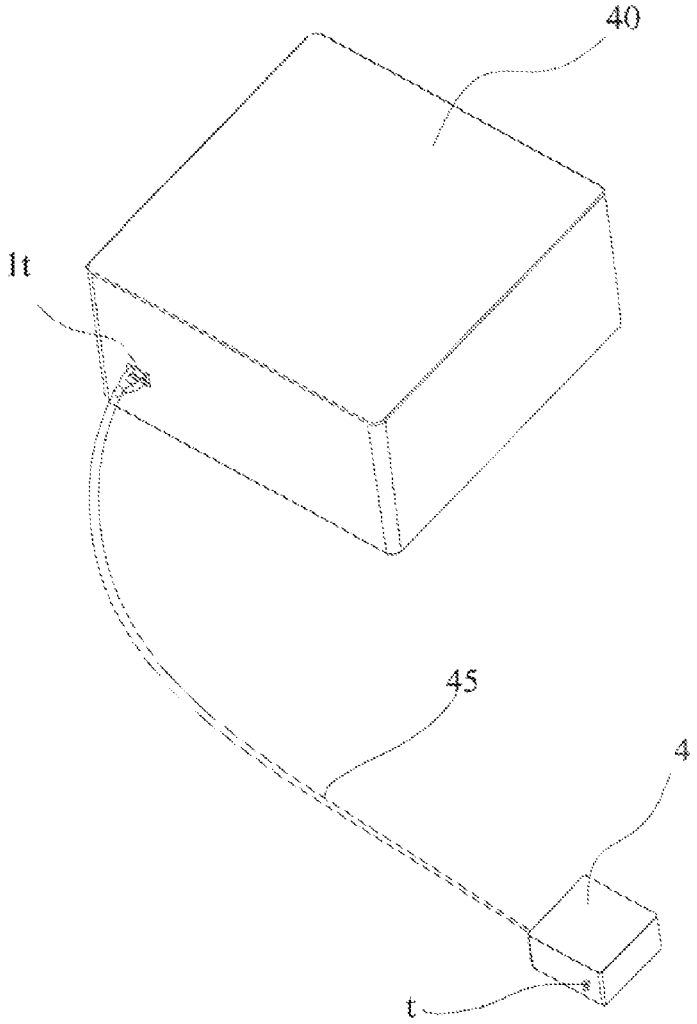
FIG. 22 is a schematic diagram of a main control box of the other embodiment according to the disclosure.

Referring to FIG. 22, a toy building block robot of the other embodiment of the present disclosure comprises a main control box 40. The main control box 40 is connected with a switch box 4 through a data cable 45.

The main control box 40 has a port 1*t* disposed thereon, wherein the main control box 40 could be the main control box of any above-mentioned embodiments. The switch box 4 also has a port t2 disposed thereon. The switch box 4 has a power switch t disposed thereon. The port 1*t* of the main control box 40 and the port t2 on the switch box 4 is electrically connected to each other through the data cable 45.

The main control box 40 has a plurality of the ports 1*t*, wherein one of the ports 1*t* is used to connect with the port t2 of the switch box 4, while the other ports 1*t* are used to connect with the servo in the toy building block robot through the data cable.

Figure 23:
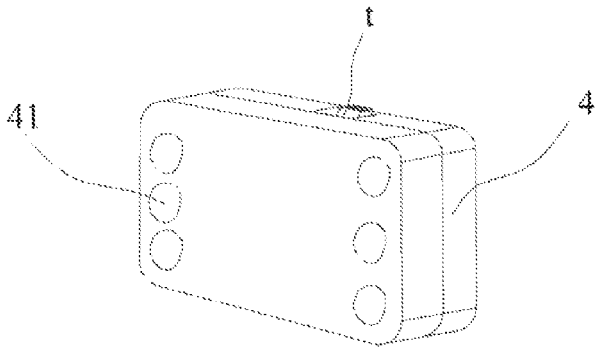
FIG. 23 is an isometric view of the switch box shown in FIG. 22.
Figure 24:
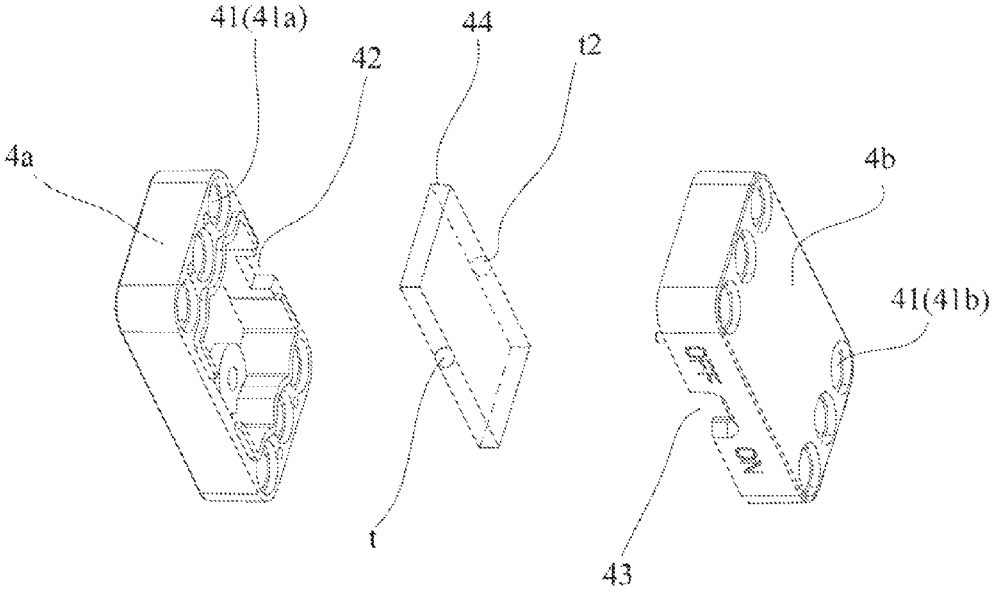
FIG. 24 is a schematic diagram of a decomposition of the switch box shown in FIG. 22.
Figure 25:
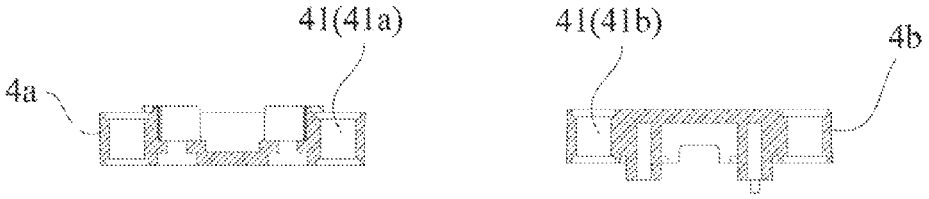
FIG. 25 is a cross-sectional schematic diagram of an upper housing and a lower housing of the switch box shown in FIG. 22.

Particularly, as shown in FIG. 23 to FIG. 25, the switch box 4 comprises a switch-box housing and a switch control board 44 locates in the switch-box housing. In this embodiment, the switch-box housing comprises an upper housing 4*b* and a lower housing 4*a*. The switch control board 44 is installed within a space formed between the upper housing 4*b* and the lower housing 4*a*. The upper housing 4*b* and the lower housing 4*a* are tightly bundled with each other through a screw after being engaged with each other. The switch control board 44 has the port t2 and the power switch t disposed thereon. The switch-box housing has a port hole 42 disposed thereon. The port t2 on the switch control board 44 is exposed from the port hole 42. The switch-box housing has a power hole 43 disposed thereon. The power switch t is exposed from the power hole 43. Particularly, the port hole 42 is disposed on the lower housing 4*a*, and the power hole 43 is disposed on the upper housing 4*b*.

Particularly, the connection mechanism of the main control box 40 of this embodiment comprises a plurality of connection pin holes which are disposed on the toy building-block robot main control housing. The connection pin holes are used to engage with other component of the toy building block robot through a bearing pin.

A plurality of upper pin holes 41*b* are disposed on the upper housing 4*b*, and a plurality of lower pin holes 41*a* are correspondingly disposed on the lower housing 4*a*. The upper pin hole 41*b* and the lower pin hole 41*a* are assembled to form the fix pin hole 41.

The switch box 4 and the main control box 40 could be connected through the bearing pin 200 shown in FIG. 18. When the bearing pin 200 is installed in the connection pin holes of the main control box 40 and the fix pin hole 41 of the switch box 4, a part of the cylindrical pin body 201 of the bearing pin 200 is engaged into the connection pin holes and the fix pin hole 41, and is limited between the above-mentioned inverse buckle protrude portion 203 and the limit stage 202. The limit stage 202 of the bearing pin 200 divides the cylindrical pin body 201 into the upper portion and the lower portion. When installing the switch box 4 on the main control box 40, two portions of the cylindrical pin body 201 on two ends of the limit stage 202 are respectively inserted into the connection pin hole on the main control box 40 and the fix pin hole 41 on the switch box 4, thereby realizing installing the switch box 4 on the main control box 40.

It can be understood that, in other embodiments, the switch box 4 could further have a butting slot like the butting slot 10*c* of the above-mentioned building block 100 disposed thereon. The connection mechanism on the main control box 40 is a connecting portion. The switch box 4 is engaged with the connecting portion on the main control box 40 through the butting slot.

In the toy building block robot and the main control box 10 thereof of this embodiment, the power switch t which originally disposed on the main control box 40 is separated therefrom, and is disposed on the switch box 4 alone. Since the on/off status of the main control box 40 is controlled by the switch box 4, and the switch box 4 and the main control box 40 are connected by the connection mechanism, which is advantageous to adjust the location of the switch box 4. As a result, the switch box 4 could be installed in a location suitable for operations, and is convenient for user to turn on/off the power switch t.

The above description depicts merely some exemplary embodiments of the disclosure, but is meant to limit the scope of the disclosure. Any equivalent structure or flow transformations made to the disclosure, or any direct or indirect applications of the disclosure on other related fields, shall all be covered within the protection of the disclosure.

What is claimed is:

1. A main control box for a toy building-block robot, comprising:

a toy building-block robot main control housing;

a toy building-block robot main control board; and a battery;

wherein the toy building-block robot main control board is installed in the toy building-block robot main control housing, the battery is connected to the toy building-block robot main control board to supply power to the toy building-block robot main control board; a plurality of connection mechanisms are disposed on the toy building-block robot main control housing for engaging the toy building-block robot main control housing with other components of the toy building block robot;

wherein the connection mechanisms comprise at least one of:

a plurality of connecting portions disposed on an outer surface of the toy building-block robot main control housing, each of the connecting portions comprises a connection pillar and a connection plate, the connection plate is installed on the outer surface of the toy building-block robot main control housing through the connection pillar; the connection plate is configured to engage into a butting slot on a building block of the toy building block robot, so as to couple the main control box with the building block, or configured to engage into a butting slot on a servo of the toy building block robot, so as to couple the main control box with the servo; the connection pillar has one or more limit grooves or one or more limit protrudes formed thereon, for matching with one or more limit protrudes or one or more limit grooves formed on the butting slot;

a plurality of connection pin holes disposed on the toy building-block robot main control housing for engaging with the component of the toy building block robot through a bearing pin; and a slot disposed on an outer surface of the toy building-block robot main control housing for engaging with the battery, wherein the toy building-block robot main control board further comprises power terminals, and the battery comprises electrodes, the power terminals on the toy building-block robot main control board are exposed within the slot; the battery is inserted into the slot, the electrodes on the battery are coupled with the power terminals on the toy building-block robot main control board.

2. The main control box of claim 1, wherein the connection plate has a square shape, four limit grooves or four limit protrudes are uniformly distributed on the connection pillar, each of the limit grooves or the limit protrudes is disposed in alignment with the center of each side of the connection plate.

3. The main control box of claim 1, wherein a chamfer is disposed on a junction between the connection pillar and the connection plate.

4. The main control box of claim 1, wherein a screw hole is formed in the connection plate and the connection pillar, such that the connecting portion is fixed on the outer surface of the toy building-block robot main control housing by inserting a screw into the screw hole.

5. The main control box of claim 1, wherein direction symbols are disposed on a top surface of the connection plate.

6. The main control box of claim 1, wherein the toy building-block robot main control housing comprises a top face, a bottom face, a front face, a back face, a left face, and a right face, the plurality of connecting portions are respectively installed on the bottom face and the back face of the toy building-block robot main control housing.

7. The main control box of claim 1, wherein the toy building-block robot main control housing comprises a top face, a bottom face, a front face, a back face, a left face, and a right face, the plurality of connection pin holes are respectively disposed on the left face and the right face of the toy building-block robot main control housing.

8. The main control box of claim 1, wherein the toy building-block robot main control housing comprises a bottom housing and a top housing, an accommodation space is formed between the bottom housing and the top housing, the toy building-block robot main control board is installed within the accommodation space;

the slot is formed on the top housing and has a truck-type concave shape, the slot is confined by a bottom side, a left side, a back side, and a right side.

9. The main control box of claim 8, wherein the connection mechanism further comprises one or more engagement holes disposed in the slot, one or more protrudes are disposed on the battery, the protrude is engaged in the engagement hole.

10. The main control box of claim 8, wherein a power hole is disposed on the slot, the power terminals of the toy building-block robot main control board are within the power hole;

the battery comprises a battery case and an electric core disposed in the battery case, the electric core has positive and negative electrodes an electrode hole corresponding to the power hole is formed on the battery case, the electrodes of the electric core are within the electrode hole.

11. The main control box of claim 10, wherein a step portion is disposed on a front opening of the slot; a protrude portion is disposed on the battery, the protrude portion is assembled within the step portion correspondingly;

the connection mechanism further comprises at least one connecting recess disposed on the step portion, at least one connecting hole is correspondingly disposed on the protrude portion, the battery is fixed within the slot through assembling an assembly part in the connecting recess and the connecting hole.

12. The main control box of claim 11, wherein the assembly part is a bearing pin formed by transparent material, at least one indicator light is disposed on the toy building-block robot main control board, the light of the at least one indicator light is capable of passing through the bearing pin formed by the transparent material.

13. The main control box of claim 1, wherein at least one first port is disposed on the main control box, the main control box is coupled with a switch box through a data cable coupled with the first port, a power switch for controlling the on/off of the main control box is disposed on the switch box.

14. The main control box of claim 13, wherein the switch box comprises a switch-box housing and a switch control board in the switch-box housing, a second port and the power switch are disposed on the switch control board;

a port hole is disposed on the switch-box housing, the second port on the switch control board is exposed from the port hole; a power hole is disposed on the switch-box housing, the power switch is exposed from the power hole.

15. The main control box of claim 14, wherein the connection mechanism comprises a plurality of connection pin holes disposed on the toy building-block robot main control housing for engaging with the component of the toy building block robot through a bearing pin;

a plurality of fix pin holes are disposed on the switch-box housing, the fix pin holes are used to install the switch box on the main control box through the bearing pin, or install the switch box on the building block or the decoration component through the bearing pin.

16. The main control box of claim 15, wherein the switch-box housing comprises an upper housing and a lower housing, the switch control board is installed within a space formed between the upper housing and the lower housing;

a plurality of upper pin holes are disposed on the upper housing, a plurality of lower pin holes are correspondingly disposed on the lower housing, one upper pin hole and one lower pin hole are assembled to form one fix pin hole.

17. A toy building block robot, comprising:

a main control box comprising a toy building-block robot main control housing, a toy building-block robot main control board, and a battery, wherein the toy building-block robot main control board is installed in the toy building-block robot main control housing, the battery is connected to the toy building-block robot main control board to supply power to the toy building-block robot main control board; a plurality of connection mechanisms are disposed on the toy building-block robot main control housing for engaging the toy building-block robot main control housing with other components of the toy building block robot;

wherein the connection mechanisms comprise at least one of:

a plurality of connecting portions disposed on an outer surface of the toy building-block robot main control housing, each of the connecting portions comprises a connection pillar and a connection plate, the connection plate is installed on the outer surface of the toy building-block robot main control housing through the connection pillar; the connection plate is configured to engage into a butting slot on a building block of the toy building block robot, so as to couple the main control box with the building block, or configured to engage into a butting slot on a servo of the toy building block robot, so as to couple the main control box with the servo; the connection pillar has one or more limit grooves or one or more limit protrudes formed thereon, for matching with one or more limit protrudes or one or more limit grooves formed on the butting slot;

a plurality of connection pin holes disposed on the toy building-block robot main control housing for engaging with the component of the toy building block robot through a bearing pin; and a slot disposed on an outer surface of the toy building-block robot main control housing for engaging with the battery, wherein the toy building-block robot main control board further comprises power terminals, and the battery comprises electrodes, the power terminals on the toy building-block robot main control board are exposed within the slot; the battery is inserted into the slot, the electrodes on the battery are coupled with the power terminals on the toy building-block robot main control board.

* * * * *